United States Patent [19]

Bergman

[11] 4,111,278

[45] Sep. 5, 1978

[54] DISCHARGE MUFFLER

[75] Inventor: Ernest R. Bergman, Rossburg, Ohio

[73] Assignee: Copeland Corporation, Sidney, Ohio

[21] Appl. No.: 767,162

[22] Filed: Feb. 9, 1977

[51] Int. Cl.[2] ..... F01N 1/00

[52] U.S. Cl. ..... 181/249; 181/255; 181/403

[58] Field of Search ..... 181/211, 229, 237, 249, 181/255, 403

[56] References Cited

U.S. PATENT DOCUMENTS

| | | | |
|---|---|---|---|
| 1,874,326 | 8/1932 | Mason | 181/255 |
| 3,752,260 | 8/1973 | Heath | 181/249 |

*Primary Examiner*—Robert C. Watson

*Attorney, Agent, or Firm*—Harness, Dickey & Pierce

[57] ABSTRACT

There is disclosed an improved sheet metal muffler for attenuating the sound of the gas discharged from a hermetic refrigeration compressor, wherein the muffler generally comprises a sheet metal casing having a hollow interior which is divided into two substantially equal chambers by a central baffle, with a restrictor tube extending through the baffle for placing the chambers in communication with one another, the restrictor tube being provided with a flared entrance portion at its upstream end and a venturi-like restriction intermediate its length.

17 Claims, 5 Drawing Figures

DISCHARGE MUFFLER

BACKGROUND AND SUMMARY OF THE INVENTION

The present invention relates generally to mufflers, and particularly to a discharge muffler for attenuating the sound resulting from the pressure pulses in the discharge of a gas compressor, such as a hermetic refrigeration compressor.

Unlike many exhaust mufflers, the mufflers required for use on hermetic compressors must meet a number of relatively complex and sometimes conflicting objectives. The most difficult objectives to meet concern the achievement of a reasonable level of sound attenuation without a significant decrease in performance. In a refrigeration compressor system it is the muffled gas which performs the work of the system, and to maintain a high level of overall efficiency and the necessary mass flow in the system the muffler must impose a minimum pressure drop in the gas flow therethrough. The difficulty lies in the fact that generally speaking the greater the degree of sound attenuation achieved by a muffler the greater the performance loss, and vice versa. Other design objectives include compactness, cost, ease of mass production, ease of assembly, reliability, and the like.

Many of the mufflers used on hermetic refrigeration compressors are variations of a "bandpass filter," one of which is a well-known muffler concept wherein two substantially equal volume chambers are joined by a tube having a length approximating the length of each chamber. The muffler of the present invention is a further improved variation of this type of sound attenuation device.

Considering the most relevant prior art of which applicant is aware, Nordquest U.S. Pat. No. 3,220,508 discloses a sheet metal multi-chamber automotive muffler wherein the baffles are retained by ridges in the muffler sides, and wherein a tube interconnects the chambers and has a restriction therein. Hald U.S. Pat. No. 3,171,506 discloses a sheet metal muffler construction for a refrigeration compressor which is formed from a plurality of "U" shaped members which are joined together to form a multi-chamber muffler. Communication between the chambers is provided by a tube extending through adjacent walls of separate "U" shaped members. Kleinlein U.S. Pat. No. 3,279,683 discloses a sheet metal muffler for a refrigeration compressor comprising an inlet tube with a restricted end portion extending through a first chamber and baffle and opening into a second chamber. The compressed gas then passes through an aperture provided in the baffle into the first chamber and out an exhaust passage communicating therewith. Gleason U.S. Pat. No. 3,458,121 discloses a multi-chamber cast muffler construction for a refrigeration compressor having a tube extending through a central baffle, and an outlet tube having an annular restriction therein. Although these prior mufflers may be satisfactory for certain of the applications for which they were designed, it is believed that the muffler of the present invention provides superior overall performance for the total cost involved.

The primary object of the present invention is thus to provide an improved discharge muffler construction which provides the required degree of sound attenuation without a significant loss of performance, and in a relatively inexpensive, compact construction which functions reliably for the life of the compressor on which it is mounted.

These and other objects, features and advantages of the present invention will become apparent from the subsequent description and the appended claims, taken in conjunction with the accompanying drawings.

DETAILED DESCRIPTION OF THE PREFERRED EMBODIMENT

Generally speaking the muffler comprises a casing 10 formed from two sheet metal elements 12 and 14. Element 14 is generally bowl-shaped, having rounded contours at the corners thereof and being provided along its open face with a circumferentially extending flange 16. Element 12 is a relatively shallow contoured element having an outer periphery complimentary in shape to the inner periphery of flange 16. Elements 12 and 14 are generally rectangular in cross-section, and the casing is formed by assembling elements 12 and 14 in the manner illustrated in FIG. 4 and then brazing them together.

Figure 2:
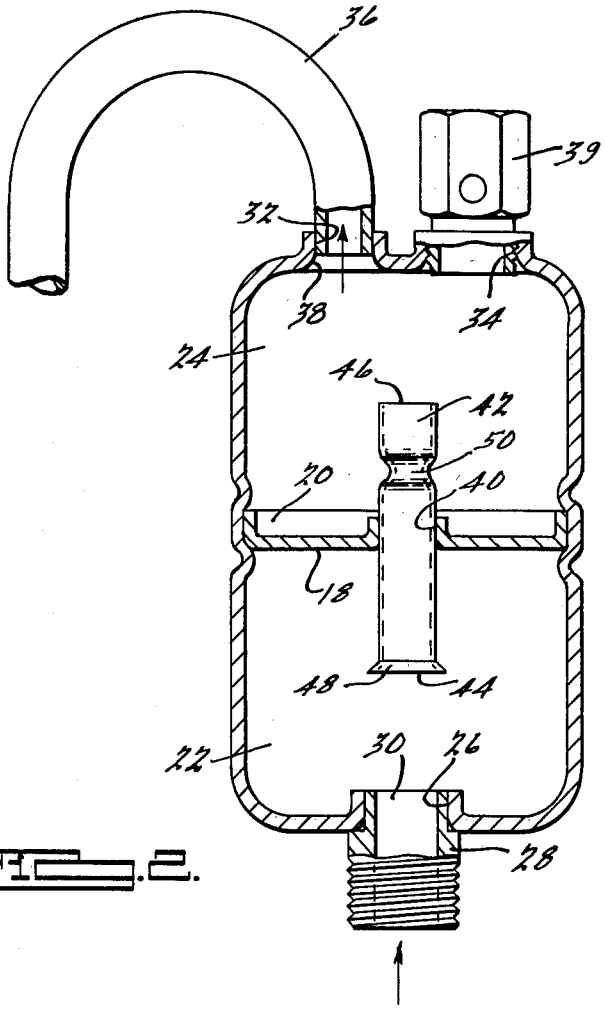
FIG. 2 is a sectional view taken substantially along line 2—2 in FIG. 1.
Figure 1:
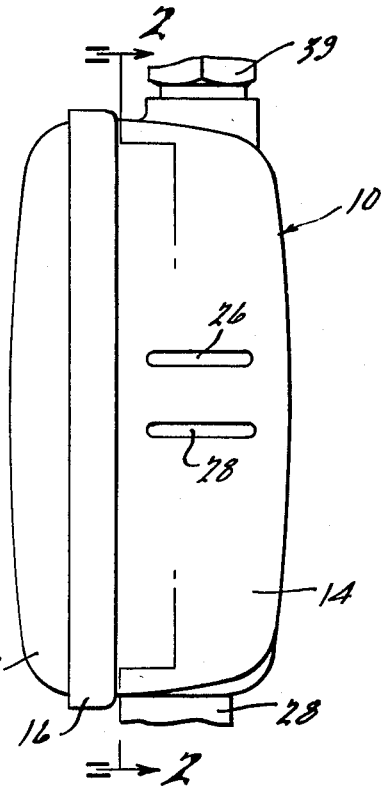
FIG. 1 is a side elevational view of a discharge muffler embodying the principles of the present invention, with certain parts broken away.
Figure 3:
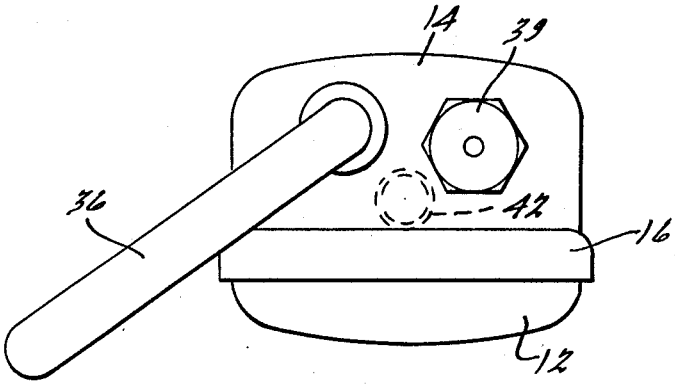
FIG. 3 is an end view looking downwardly on the top of the discharge muffler as illustrated in FIGS. 1 and 2.

Disposed within casing 10 is a partition 18, also formed of sheet metal, which is substantially flat in configuration and is provided with a continuous peripheral flange 20 to increase its stiffness. Partition 18 is positioned within the interior of casing 10 so as to divide the casing into two substantially equal volume and shaped chambers 22 and 24, and is retained in place by means of a pair of ridges 26 and 28 on each side of casing element 14, as best seen in FIGS. 1 and 2. Once positioned, partition 18 may be brazed in place so as to increase the rigidity of the structure and isolate chambers 22 and 24 from one another.

In the lower end wall of casing element 14 as shown, there is provided a flanged opening 26 in which is secured, by brazing or the like, an inlet fitting 28 having an inlet passageway 30 therethrough. The outside diameter of the outwardly projecting portion of inlet fitting 28 may be provided with suitable pipe threads or the like to facilitate attachment of the discharge muffler to the compressor being muffled.

The upper end of casing element 14 as shown, is provided with flanged openings 32 and 34. Opening 32 has mounted therein, as by brazing or the like, a gas discharge line 36 which may be of any contour desired and provides a path for communicating discharged gas to the point of use thereof. As best seen in FIG. 2, the inlet to discharge line 36 is smoothly contoured, as at 38, to reduce fluid flow losses of the gas passing from chamber 24 into the discharge line. Opening 34 has threadably disposed therein a conventional pressure relief valve 39. This pressure relief valve provides the normal function of relieving excess pressure which may occur in the muffler, to thereby prevent damage to the latter. Normally there is no flow of fluid through opening 34 and the pressure relief valve.

Figure 4:
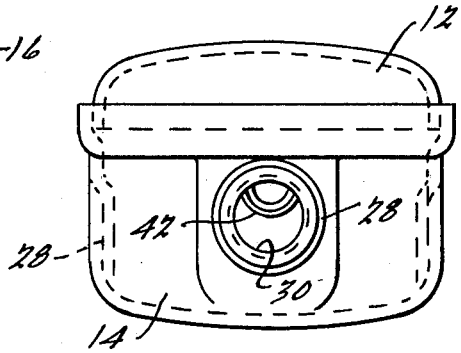
FIG. 4 is an end view looking upwardly at the bottom of the discharge muffler as illustrated in FIGS. 1 and 2.

Partition 18 is provided in the approximate center thereof with a flanged opening 40 in which is affixed, as by brazing or the like, a metal restrictor tube 42. Tube 42 is of a length approximately equal to the length of each of the chambers 22 and 24 (in the vertical direction as shown) and is mounted at approximately its mid point, so that the inlet end of the restrictor tube, indicated at 44, is disposed at approximately the center of chamber 22, and the outlet end of the tube, indicated at 46, is disposed at approximately the center of chamber 24. To smooth the flow of gas into restrictor tube 42, it is provided as its inlet end with a flared entrance portion 48. The axis of tube 42 is substantially parallel to the axis of inlet passageway 30, but is slightly eccentric with respect thereto. As best seen in FIG. 4, the axis of tube 42 lies in the same transverse plane as does the axis of inlet passageway 30 but they are slightly spaced apart. It is believed that this slight offset relationship helps attenuate noise by blocking to some extent the pressure pulses emanating from the compressor. If the two passageways are aligned coaxially with one another the muffler appears to be somewhat noisier. On the other hand, too much offset will cause excessive flow losses with an attendant reduction in performance. The same basic relationship exists on the outlet side of the muffler when considering the respective positions of the axes of the discharge line and the outlet end of restrictor tube 42; however, because the pressure pulses are less at this point the relationship is less critical. In fact, satisfactory results may even be obtained by bringing the discharge line into the side wall of chamber 24.

Intermediate its ends, restrictor tube 42 is provided with an annular restriction 50. Although the specific manner in which the muffler operates is not fully understood, it is believed that restriction 50 acts to assist in reflecting the pressure pulses in the fluid passing through the muffler to thus help or aid in attenuating the sound thereof. Because restriction 50 does function to substantially reduce the effective diameter of the passageway through restrictor tube 42, it does introduce a significant pressure drop in the system. For this reason, it is so contoured and positioned with respect to the overall length of the restrictor tube that it acts as a venturi, with the equivalent of a diverging nozzle immediately downstream thereof. This diverging nozzle configuration operates to provide pressure drop recovery from that which would otherwise result from the restriction itself acting as an orifice.

Although the design of a discharge muffler for attenuating the sound caused by the pressure pulses in a compressor discharge is necessarily somewhat empirical, there are several parameters which can be followed. Generally speaking, it is the lower frequencies which create the greatest problem and for the attenuation of which the muffler is primarily designed. These frequencies result from the pulses caused by the opening of the discharge valves of the compressor as it pumps at operating speed. Consequently, the larger the muffler the better, the overall size limited by available space and cost limitations. The higher frequencies are damped or attenuated primarily by utilizing a relatively stiff muffler construction, such as is obtained with relatively heavy and/or strong materials, and by making sure that the passageway through the restrictor tube is not too large in diameter.

In designing the restrictor tube the preferred approach is to pick a tube diameter which gives the desired pressure pulse attenuation at operating conditions. The restriction in the tube may be one which gives a reduced cross-sectional area between approximately 30% and approximately 60% of the effective area of the unrestricted portion of the passageway through the tube, and can be at least initially positioned in the general vicinity shown. The tube diameter should thereafter be preferably increased, along with the entrance flare and restriction, to improve performance (i.e., maximize mass flow and minimize pressure drop) while at the same time maintaining the desired pulse attenuation. Generally speaking, the higher the ratio of tube length to inside diameter the greater the high frequency attenuation, and therefore the diameter should not be increased to the point where it is so great that it starts permitting high frequencies to readily pass therethrough.

Figure 5:
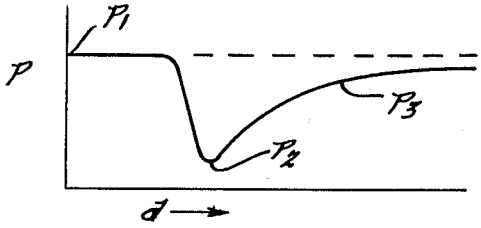
FIG. 5 is a graphical representation of the fluid pressure which exists at different positions in a part of the discharge muffler.

With respect to the preferred position of the restriction, FIG. 5 illustrates generally the pressure conditions throughout the length of the passageway in restrictor tube 42 for steady state flow. The vertical axis is pressure with $P_1$ being the pressure of the fluid as it enters the restrictor tube, and the horizontal axis is distance from the inlet end of the restrictor tube. As can be seen, the fluid passes through the tube with minimal pressure drop until it reaches restriction 50, at which time the pressure drops to some value indicated at $P_2$. Because of the convergent/divergent contour of the restrictor tube passageway, however, immediately downstream of the restriction there is a significant pressure recovery. As can be seen, the pressure of the fluid downstream of the restriction increases as a function of its distance from the restriction and asymtotically approaches some value less than $P_1$. For a given length restrictor tube, the restriction 50 should be positioned far enough from the discharge end that significant pressure recovery has occurred, such as indicated at $P_3$ in FIG. 5, where it can be seen that the pressure is approaching its recovered value. The restriction, however, should not be put any further away from the outlet end of the restrictor tube than is necessary because it is desirable to provide sufficient upstream length in the tube to straighten out as much as possible the gas flow therethrough. The restriction may be formed in any desired manner, such as by rolling.

Insofar as performance in terms of mass flow and pressure drop is concerned, in the embodiment for which the present muffler was designed a pressure drop of 15 psi in a 200 to 300 psi fluid was considered tolerable for the entire discharge system from the cylinder head of the compressor to the outlet of the hermetic shell in which it was disposed, with approximately 6 to 9 psi pressure drop in the muffler itself being tolerable. It is estimated that this latter pressure drop comprises roughly 1 to 2 psi pressure drop in the inlet passageway, 4 to 5 psi pressure drop through the restrictor tube, and 1 to 2 psi pressure drop at the entrance to the discharge line.

Thus, there is disclosed in the above description and in the drawings an improved discharge muffler which fully and effectively accomplishes the objectives thereof. However, it will be apparent that variations and modifications of the disclosed embodiment may be made without departing from the principles of the invention or the scope of the appended claims.

What is claimed is:

1. A discharge muffler for a gas compressor comprising:
a casing having a hollow interior;
a partition in said casing dividing said hollow interior into first and second chambers of substantially equal volume and dimensions;
a relatively straight restrictor tube extending through said partition, said restriction tube being of a length approximating the length of one of said chambers in the direction of gas flow therethrough and having
open ends with a central passageway extending therethrough,
a flared entrance to said passageway at one said open end, and
an annular restriction in said passageway between said open ends, said restriction being spaced from the opposite open end a distance sufficient to permit a significant recovery in the pressure drop caused by said restriction at design operating conditions;
an inlet passage communicating with said first chamber; and
an outlet passage communicating with said second chamber.

2. A discharge muffler as claimed in claim 1, wherein the ends of said restrictor tube are disposed generally in the centers of said first and second chambers, respectively.

3. A discharge muffler as claimed in claim 1, wherein said restrictor tube extends through said partition and is affixed thereto at a point approximately mid way between the ends of said restrictor tube.

4. A discharge muffler as claimed in claim 1, wherein said central passageway is of substantially constant diameter throughout its length except for said flared entrance and annular restriction.

5. A discharge muffler as claimed in claim 4, wherein said inlet passage is of a cross-sectional area which is greater than said constant diameter portion of said central passageway.

6. A discharge muffler as claimed in claim 1, wherein the axis of said inlet passage area is substantially parallel and eccentric to the axis of said central passageway.

7. A discharge muffler as claimed in claim 1, wherein said inlet passage is spaced from said central passageway.

8. A discharge muffler as claimed in claim 1, wherein said outlet passage is spaced from said central passageway.

9. A discharge muffler as claimed in claim 1, wherein the planes of said annular restriction and said flared entrance are generally parallel to one another and perpendicular to the axis of said restrictor tube.

10. A discharge muffler as claimed in claim 1, wherein said restrictor tube extends through said partition at approximately the center of the latter.

11. A discharge muffler as claimed in claim 1, wherein said partition has an integral flange around the periphery thereof and is disposed between adjacent ridges formed in the wall of said casing.

12. A discharge muffler as claimed in claim 1, further comprising means defining a contoured surface at the entrance of said outlet passage to reduce the pressure drop of gas flowing into said outlet passage.

13. A discharge muffler as claimed in claim 1, wherein said central passageway is of substantially constant diameter for a portion of the length thereof and where its diameter is substantially equal to the diameter of said outlet passage.

14. A discharge muffler as claimed in claim 1, wherein said open ends of said central passageway are substantially unrestricted.

15. A discharge muffler as claimed in claim 1, wherein the effective cross-sectional area of the restricted portion of said central passageway is from approximately 30% to approximately 60% of the effective cross-sectional area of the remainder of said central passageway.

16. A discharge muffler for a gas compressor comprising:
a casing having a hollow interior:
a partition in said casing dividing said hollow interior into first and second chambers of substantially equal volume;
a relatively straight restrictor tube extending through said partition, said restriction tube being of a length approximating the length of one of said chambers in the direction of gas flow therethrough and having
open ends with a central passageway of substantially constant diameter extending therethrough,
an annular restriction in said passageway between said open ends, said restriction being spaced from the downstream end of said restrictor tube a distance sufficient to permit a significant recovery in the pressure drop caused by said restriction at design operating conditions;
an inlet passage communicating with said first chamber; and
an outlet passage communicating with said second chamber.

17. A discharge muffler for a gas compressor comprising:
a sheet metal casing having a hollow interior;
a partition in said casing dividing said hollow interior into first and second chambers of substantially equal volume;
a relatively straight restrictor tube extending through said partition in the vicinity of the center thereof, said restriction tube being of a length approximating the length of one of said chambers in the direction of gas flow therethrough and having
open ends with a central passageway of substantially constant diameter extending therethrough,
one said end being disposed generally in the center of said first chamber and the opposite said end being disposed generally in the center of said second chamber,
a flared entrance to said passageway at said one open end, and
an annular restriction in said passageway between said open ends, said restriction being spaced from said opposite end a distance sufficient to permit a significant recovery in the pressure drop caused by said restriction at design operating conditions;
an inlet fitting in said casing having an inlet passage communicating with said first chamber,
the axis of said inlet passage being substantially parallel and eccentric to the axis of said passageway,
said inlet passage being spaced from said passageway; and
an outlet fitting in said casing having an outlet passage communicating with said second chamber,
said outlet passage being spaced from said passageway.

* * * * *